US007913743B2

(12) United States Patent
Bedzyk

(10) Patent No.: US 7,913,743 B2
(45) Date of Patent: Mar. 29, 2011

(54) METHOD OF FORMING A PATTERN

(75) Inventor: Joseph Bedzyk, Mentor, OH (US)

(73) Assignee: PCC Airfoils, Inc., Beachwood, OH (US)

( * ) Notice: Subject to any disclaimer, the term of this patent is extended or adjusted under 35 U.S.C. 154(b) by 350 days.

(21) Appl. No.: 12/138,023

(22) Filed: Jun. 12, 2008

(65) Prior Publication Data

US 2009/0308564 A1 Dec. 17, 2009

(51) Int. Cl.
*B22C 9/04* (2006.01)

(52) U.S. Cl. ..... 164/45; 164/35; 164/516

(58) Field of Classification Search ..... 164/35, 164/45, 516, 246
See application file for complete search history.

(56) References Cited

U.S. PATENT DOCUMENTS 3,074,112 A 1/1963 Bobrow
3,662,816 A 5/1972 Bishop et al.
4,283,835 A 8/1981 Obrochta et al.
4,289,191 A 9/1981 Myllymaki
4,913,217 A 4/1990 Koch et al.
5,505,250 A 4/1996 Jago
5,580,837 A 12/1996 Dodds et al.
6,582,197 B2 6/2003 Coulson
7,296,615 B2 11/2007 Devine, II et al.
7,322,396 B2 1/2008 Govern et al.

*Primary Examiner* — Kuang Lin
(74) *Attorney, Agent, or Firm* — Tarolli, Sundheim, Covell & Tummino LLP

(57) ABSTRACT

A method of forming a pattern includes providing an actual core having dimensions which are different from dimensions of an ideal core. A best fit spatial relationship of the actual core to a spatial envelope for an ideal core is determined. Locating surfaces in a die are moved to positions, at least some of which are offset from ideal core locating positions, in which the actual core is positioned in a best fit spatial relationship with the spatial envelope for the ideal core. A plurality of motors may be utilized to move the core locating surfaces to desired locating positions. The actual core is positioned in engagement with the core locating surfaces and a flow of wax is conducted into the die. If desired, a best fit spatial relationship of the actual core to a die cavity may be determined, rather than a best fit with an ideal core.

94 Claims, 5 Drawing Sheets

METHOD OF FORMING A PATTERN

BACKGROUND OF THE INVENTION

The present invention relates to a new and improved method for forming a pattern which includes a core which is at least partially covered by wax.

Articles, such as an airfoil, have been formed by a lost wax investment casting process. The process may include forming a pattern having the configuration of a space or cavity to be formed in a mold in which an article is to be cast. A core portion of the pattern has a configuration corresponding to the configuration of a space to be formed in the article.

To form the pattern, the core is positioned in a die cavity. Wax is injected into the die cavity around the core. The resulting pattern may subsequently be covered with a ceramic mold material.

Once the pattern has been covered with a ceramic mold material, the wax portion of the pattern is melted. The wax is removed from the mold to leave a cavity into which metal is cast. The core is at least partially enclosed by this cast metal. The core is subsequently removed to form space in the cast metal article. The space formed by the core may be a complex arrangement of passages.

The concept of supporting a core in a die cavity using fixed and/or spring loaded pins to support the core is disclosed in U.S. Pat. No. 4,283,835. A system which allows for design changes, such as a shift in core location, is disclosed in U.S. Pat. No. 7,296,615.

SUMMARY OF THE INVENTION

The present invention provides a new and improved method of forming a pattern which includes a core which is at least partially covered by wax. The method includes providing an actual core having dimensions which differ from dimensions of an ideal core, that is, a core which exactly conforms to a specific design for the core. A best fit spatial relationship of the actual core to a spatial envelope for the ideal core may be determined. This results in space formed by the actual core in a cast metal article having a best fit relationship with the cast metal article. If desired, a best fit spatial relationship of the actual core to a pattern die cavity may be determined, rather than a best fit with an ideal core.

A die having a plurality of core locating surfaces is provided. The core locating surfaces in the die are movable between a plurality of positions including ideal core locating positions, in which the ideal core would be positioned in a desired spatial relationship relative to the die. The core locating surfaces in the die are movable to actual core locating positions which are offset from the ideal core locating positions. When the core locating surfaces are in the actual core locating positions, an actual core which is disposed in engagement with the core locating surfaces is positioned in a best fit spatial relationship with the spatial envelope for the ideal core. This results in the actual core being positioned in a best fit spatial relationship with a die cavity in which the pattern is formed.

The actual core is positioned in engagement with the core locating surfaces while the core locating surfaces are in the actual core locating positions. A flow of wax is conducted into the die while the actual core is in engagement with the core locating surfaces and while the core locating surfaces are in the actual core locating positions.

A plurality of motors may be utilized to move the core locating surfaces relative to the die. In one embodiment of the invention, the core locating surfaces which are moved by the motors are disposed in association with only one section, for example, the lower section, of the die. However, motors may be associated with locating surfaces associated with a second section, in the example, the upper section, of the die if desired.

The present invention has a plurality of different features. These features may be utilized together as disclosed herein or may be utilized separately and/or in combination with features from the prior art. For example, core locating surfaces may be moved by manually actuating one or more drive trains. As another example, motors may be utilized to move core locating surfaces to positions other than positions in which an actual core is positioned in a best fit spatial relationship with a spatial envelope for an ideal core.

BRIEF DESCRIPTION OF THE DRAWINGS

The foregoing and other features of the present invention will become more apparent upon a consideration of the following description taken in connection with the accompanying drawings wherein.

DESCRIPTION OF SPECIFIC PREFERRED EMBODIMENTS OF THE INVENTION

Background and General Description

Figure 1:
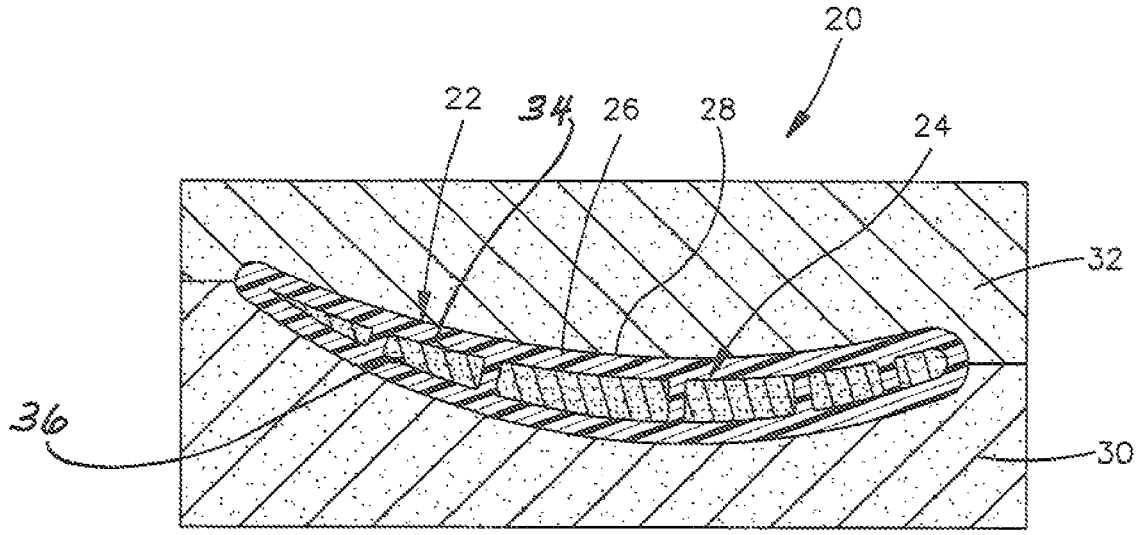
FIG. 1 is a simplified schematic sectional view illustrating a pattern disposed in a die, a core of the pattern is at least partially covered by wax.

A die 20 (FIG. 1) is utilized in the forming of a pattern 22. The pattern 22 includes a known core 24 which is at least partially covered by known natural or artificial wax 26. The pattern 22 is held, in a die cavity 28, between a lower section 30 and an upper section 32 of the die 20.

The pattern 22 is removed from the die 20. Thereafter, the pattern 22 is at least partially enclosed with a suitable mold material. For example, the pattern 22 may be enclosed with a slurry of a ceramic material which solidifies over the outside of the pattern to form a mold.

The wax 26 is then removed from the mold to form a cavity in the mold. The core 24 is disposed in the cavity in the mold. The cavity in the mold is filled with molten metal which solidifies around the core to form a cast article. The core 24 is subsequently removed from the cast metal article to form passages or space in the cast article.

In order to form the mold which at least partially encloses the pattern 22, the pattern may be covered with a known liquid ceramic mold material. The pattern 22 may be covered with a liquid ceramic mold material by repetitively dipping the pattern in a slurry of liquid ceramic mold material. Although many different types of slurries of ceramic mold material may be utilized, one illustrative slurry contains fused silica, zircon and other refractory materials in combination with binders. Chemical binders, such as ethyl silicate, sodium silicate and colloidal silica can be utilized. In addition, the slurry may contain suitable film formers such as alginates to control viscosity and wetting agents to control flow characteristics and pattern wettability.

The use of a pattern, similar to the pattern 22, having a core, similar to the core of 24, enclosed by wax, similar to the wax 26, is well known. The pattern 22 may be enclosed by any one of many different known types of mold material and the foregoing discussion of a ceramic mold material should be considered as being illustrative of many different mold materials which may be utilized in association with the pattern 22.

The pattern 22 is configured to form an airfoil, such as a blade or vane for a turbine engine. However, the pattern 22 may be configured to form many different articles other than a blade or vane of a turbine engine. For example, the pattern 22 may be configured to form a blade outer air seal for use in a turbine engine. Alternatively, the pattern 22 may be configured to form articles which are used in environments other than in a turbine engine.

The core 24 may be formed of any desired material. The illustrated core is formed of a known ceramic material and may have a configuration and composition similar to the configuration and composition of the core disclosed in U.S. Pat. No. 5,580,837. However, it should be understood that the core 24 may be formed of many different materials and may have many different compositions. However, when the core 24 is to be utilized is association with a ceramic mold during the casting of turbine engine components, it is believed that it may be advantageous to have the core 24 formed of a ceramic material which is compatible with a ceramic material forming the mold.

The wax 26 at least partially encloses the core may be either a natural or artificial wax. After the pattern 22 has been enclosed by a ceramic mold material, the wax 26 is removed from the resulting molds to leave a space within the mold. This space will have a configuration corresponding to the desired configuration of a metal article, such as a cast metal blade or vane used in a turbine engine. The core 24 is left in the mold.

After molten metal has been solidified in the space formed in the mold by removal of the wax 26, the resulting the metal article is removed from the mold. The core 24 is then removed from the metal article. Removal of the core 24 results in the formation of space, such as airflow passages, in the resulting metal article.

Although the core 24 may be formed of many different materials and in many different ways, the illustrated core is formed by mixing a ceramic material with a binder. The resulting mixture is injection molded to form a compact or green core having a configuration corresponding to the desired configuration of the core. This green core or compact is then sintered to form the ceramic core 24.

During formation of the illustrated core 24, a ceramic material and binder or carrier are mixed. Although many different binders may be utilized, the binder may include a water soluble and a water insoluble component. The water soluble and water insoluble components of the binder may be completely miscible in each other when they are in a liquid state. This facilitates mixing of the components of the binder.

The water soluble component of the binder may include at least one hydrophilic functional group. The water insoluble component of the binder may be a polymer having hydroxyl groups copolymerized with non-polar diluents to such an extent as to be insoluble with a water-based media. The water soluble component and water insoluble component of the binder may initially be powders which are heated to change them from the solid state to their liquid states.

The liquid heterogeneous mixture of water soluble and water insoluble components of the binder are mixed with a ceramic powder. The powder may be coated with a dispersant, lubricant and/or surfactant, to form a substantially uniform feedstock. The mixing of the binder with the ceramic powder may occur at elevated temperatures in a sigma blade mixture. During mixing, the binding has a relatively low viscosity. The substantially uniform mixture of binder and powder forms a feedstock.

The feedstock is injection molded in a die to form a compact or green core. The feedstock is molded to a configuration which is a function of the configuration of an ideal core, that is, a core which conforms exactly to a design for the core.

It may be desired to at least partially remove the binder from the compact or green core before sintering the compact or green core. Thus, there is a partial debinding of the compact by removing at least a portion of the water soluble component of the binder. This may be accomplished by exposing the compact to a water-based solvent which removes at least a portion of the water soluble component of the binder.

When sufficient debinding of the compact or green core has been accomplished to remove a desired amount of the water soluble component of the binder, the compact or green core may be withdrawn from exposure of the water based solvent. The compact may then be slowly dried in a moisture rich atmosphere.

After the soluble component of the binder has been at least partially removed from the compact or green core and the compact has been slowly dried, the water insoluble component of the binder and any remaining portion of the water soluble component may be removed. This may be accomplished by heating the compact or green core to a temperature above 1,000° F. in a suitable furnace.

After removal of the water soluble and water insoluble components to the binder, the powder particles of the ceramic material are mechanically held together. The compact or green core is then sintered in a suitable furnace to bond the powdered particles of the ceramic material together. The compact may, typically, be sintered at a temperature of approximately 1,500° to 1,650° C.

The specific composition of the core 24 and the manner in which the core is formed is known and do not, in and of themselves, form a part of the present invention. The core 24 may be formed in any desired way utilizing any desired materials. The foregoing specific manner of forming the core and components utilized in the core have been set forth herein merely for background. This background has been set forth for purposes of clarity of description and not for purposes of limiting the invention.

Although the present invention may be utilized in association with the forming of many different types of articles, the illustrated pattern 22 is for use in forming an airfoil which is utilized in a turbine engine. The core 24 has a concave side surface 34 (FIG. 1) and a convex side surface 36. During the casting of an airfoil, the concave side surface 34 of the core 24 forms a concave side of a passage or space in the airfoil. The convex side 36 of the core 24 forms a convex side of the passage or space in the airfoil.

Use of an Imperfect Core

When the core 24 has been formed, the core will have a configuration which differs, to at least some small extent, from the configuration of an ideal or perfect core. The actual core 24 will have dimensions and a configuration which are not exactly the same as the dimensions and configuration of a design core, that is, the ideal core. Although the dimensions of the actual core 24 will differ from the dimensions of an ideal (perfect) core, an article cast with the actual core should have internal space or passages which match, as closely as possible, the internal space or passages formed by an ideal core. Any deviation in the space or passages which are formed in a cast article by an actual core 24 from the space or passages formed by an ideal core will effect the strength and/or operating characteristics of the article cast with the actual core 24.

During production of a substantial number of actual cores 24, each of the cores may have dimensions and/or a configuration which are within a manufacturing tolerance range from the dimensions and/or configuration of an ideal core. However, due to the many variables in forming an actual core 24, including debinding and sintering, the dimensions and/or configuration of the actual core will deviate by a small amount from the dimensions and/or configuration of an ideal or perfect core. Of course, during manufacture of an actual core 24, it is endeavored to form the core with a configuration and dimensions which are as close as possible to the configuration and dimensions of an ideal (perfect) core.

Figure 2:
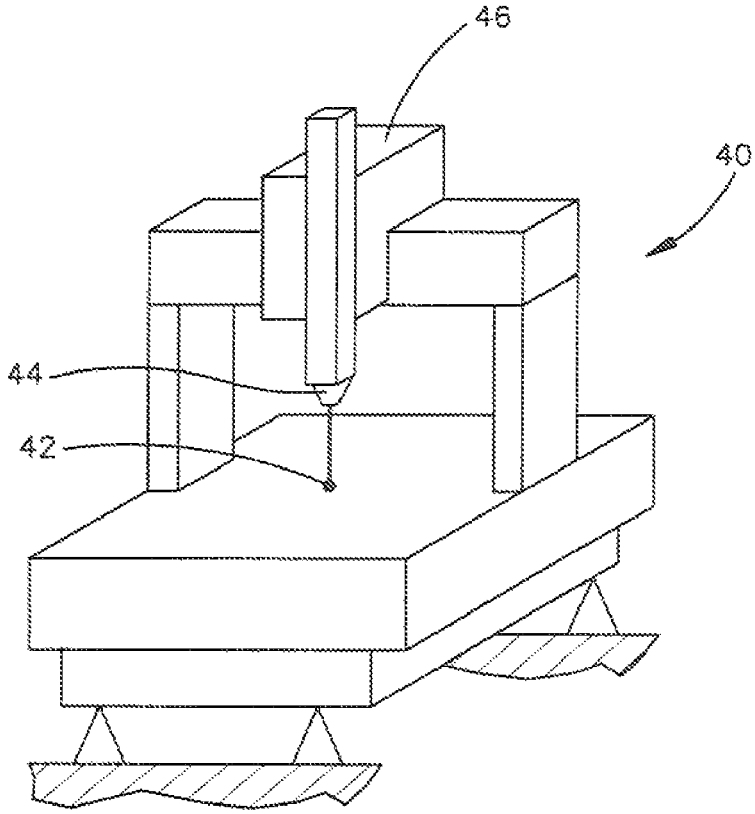
FIG. 2 is a schematic illustration of a coordinate-measuring machine which may be utilized to measure an actual core.

When an actual core 24 has been formed, it is measured to determine the actual configuration and dimensions of the core. To measure the actual core 24, a known coordinate-measuring machine 40 (FIG. 2) may be utilized. The coordinate-measuring machine 40 includes a probe 42 disposed on a probe head 44. The probe head 44 touches the core 24 at different spots where the core 24 is to be measured.

The coordinate-measuring machine 40 uses the x,y and z coordinates of selected points on the core 24 to determine the dimensions and configuration of the core 24. If desired, the probe 42 may drag along the surface of the core 24 and take measurements at points at specified intervals. It is contemplated that a laser may be utilized to scan the core 24 rather than a mechanical probe.

A carriage 46 is disposed on a support frame of the coordinate-measuring machine 40. The probe head 44 is connected to the carriage 46. Outputs from the probe head 44 and carriage 46 are transmitted to registers, that is, data storage units in a computer, to store data corresponding to the measurements of the actual core 24.

In accordance with one of the features of the present invention, the computer determines the best fit of the measured data points on the actual core 24 to corresponding data points on an ideal core. The computer stores the dimensions and configuration of the ideal core. Measured dimensions and configuration of the actual core 24, as measured with the coordinate measuring machine 40, are compared to the desired dimensions and configuration of the ideal core by the computer. The computer determines a best fit relationship between the actual measured data for the actual core 24 and the stored data for the ideal or perfect core.

The computer contains software which determines when a best fit spatial relationship is obtained between an actual core 24 and an ideal (perfect) core. The software is commercially available from many different sources. In the illustrated embodiment of the invention, the software was Camio Studio 4.6 software which was obtained from Metris USA having a place of business at 12701 Grand River, Brighton, Mich. 48116 and at 1577 Star Batt Drive, Rochester Hills, Mich. 48309. Of course, it is contemplated that the software may and will be obtained from other sources.

Figure 3:
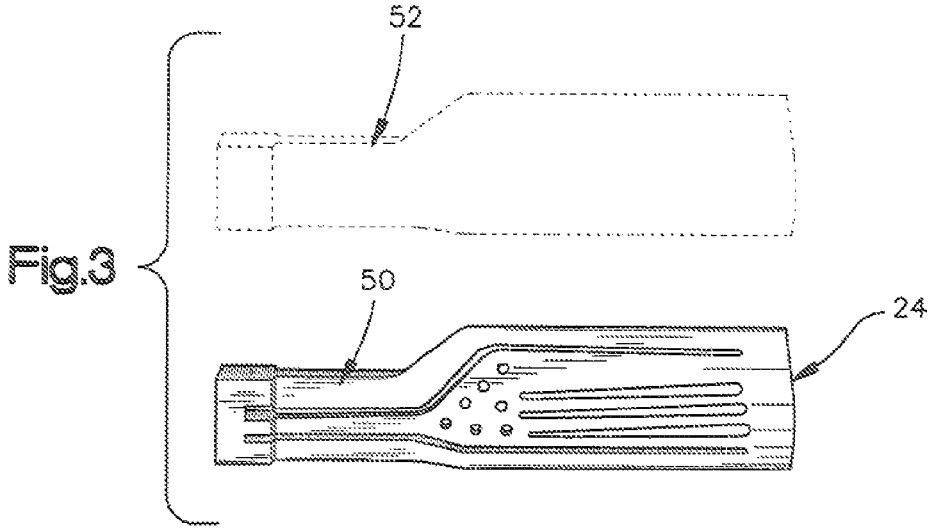
FIG. 3 is a schematic illustration depicting an actual core and a spatial envelope of an ideal core.

The manner in which the computer determines the best fit relationship between the measured dimensions of the actual core 24 and the corresponding dimensions of the ideal core is illustrated schematically in FIG. 3. The actual core 24 has a spatial envelope with a configuration and dimensions which have been indicated schematically at 50 in FIG. 3. The dimensions and configuration of a spatial envelope of an ideal (perfect) core are indicated schematically at 52 in FIG. 3.

The actual core dimensions measured by the coordinate measuring machine 40 enable a spatial envelope 50 for the actual core 24 to be determined. The spatial envelope 52 of the ideal core is determined from the design dimensions of the ideal core. The spatial envelope 50 of the actual core 24 can differ from the ideal spatial envelope 52 within a manufacturing tolerance range.

The acceptance of the actual core 24 with dimensions and a configuration which differs, within a tolerance range, from the dimensions and configuration of the ideal core is necessary in order to accommodate the inevitable small deviations which occur during manufacturing of the actual cores. These small deviations may be the result of debinding and/or sintering of the actual core 24. Of course, variations in the dimensions and/or configuration of the actual core 24 from the dimensions and configuration of the ideal core may be the result of factors other than debinding and/or sintering of the actual core.

When the actual core 24 is positioned in the die cavity 28 in a best fit spatial relationship with the spatial envelope 52 for an ideal core correctly located in the die, the spatial envelope 50 of the actual core is congruent, to the maximum extent possible, with the spatial envelope for the ideal core. By having the actual core 24 positioned in the die 20 in a best fit spatial relationship with the spatial envelope 52 for the ideal core, deviations in the dimensions and/or configuration of the wax 26 which is injection molded around the actual core from a design dimension and/or configuration for the wax are minimized. This results in minimal deviations in a wall of an article cast using the pattern 22.

When the actual core 24 is positioned in the die cavity 28 in a best fit relationship with an ideal core, the actual core is also in a best fit spatial relationship with both an ideal core and the die cavity 28. The wax 26 is subsequently molded in the die cavity 26 with dimensions and a configuration which are as close as possible to the ideal (design) dimensions and configuration for the wax. This results in a metal article, which is subsequently cast using the pattern 22, having dimensions and a configuration which are as close as possible to the ideal (design) dimensions and configuration for the cast metal article. When the actual core 24 is removed from the cast metal article, space is formed in the cast metal article. This space will have dimensions and a configuration which are as close as possible to the ideal (design) dimensions and configuration for the space.

When the core 24 is to be positioned in the die 20 in a best fit spatial relationship with the spatial envelope 52 for the ideal core when the ideal core is in a desired spatial relationship to the die, the positions of at least some core positioning members 62 (FIG. 4) of a plurality of core positioning members are adjusted. The core positioning members 62 are moved, relative to the die 20, to positions in which the actual core 24 can be supported in a position in which the spatial envelope 50 of the actual core is in a best fit spatial relationship with the spatial envelope 52 for the ideal core when the ideal core is in a desired (design) position relative to the die.

When the actual core 24 is in a best fit spatial relationship with the spatial envelope 52 for the ideal core, the actual core 24 will also be in a best fit spatial relationship with the die cavity 28.

In accordance with one of the features of the present invention, a plurality of motors 74 (FIG. 4) are operated to move the core positioning members 62 to locating positions in which the core positioning members will be disposed when the core 24 is in the best fit spatial relationship to a spatial envelope 52 of the ideal core. Thus, if it is assumed that the core positioning members 62 are initially moved to the positions in which they would locate an ideal core relative to the lower and upper die sections 30 and 32, the motors 74 are operated to move at least some of the core positioning members 62 to core locating positions which are offset from the ideal core locating positions.

The motors 74 are operated to move core positioning members 62 to positions in which core locating surfaces 60 are offset from the positions in which they would be disposed if the core 24 had the dimensions and configurations of an ideal core. This results in the actual core 24 being located in a best fit relationship with a spatial envelope 52 of the ideal core when the ideal core is disposed in the die 20. This also results in the actual core 24 being located in a best fit relationship with the die cavity 28.

The amounts by which the core locating surfaces 60 on the core positioning members 62 are offset from positions they would be in if the core 24 was an ideal core, is entered into a controller (computer) 80. The controller 80 is connected with the motors 74. The controller 80 effects operation of the motors 74 to move the core locating surfaces 60 to positions which are offset from positions the core locating surfaces would be in if the core was an ideal core. The controller 80 effects operation of the motors 74 to move the core locating surfaces 60 to positions in which the core locating surfaces can position the actual core 24 in a best fit relationship with both the spatial envelope 52 for the ideal core and the die cavity 28.

If desired, the coordinate-measuring machine 40 may be connected directly to the controller. Data, corresponding to the measurements made by the coordinate-measuring machine 40 may be stored in registers (data storage units) 82 in the controller 80. This would enable the controller 80 to determine the amounts by which the core positioning surfaces 60 are to be offset from the positions they would be in if the core 24 was an ideal core.

Figure 4:
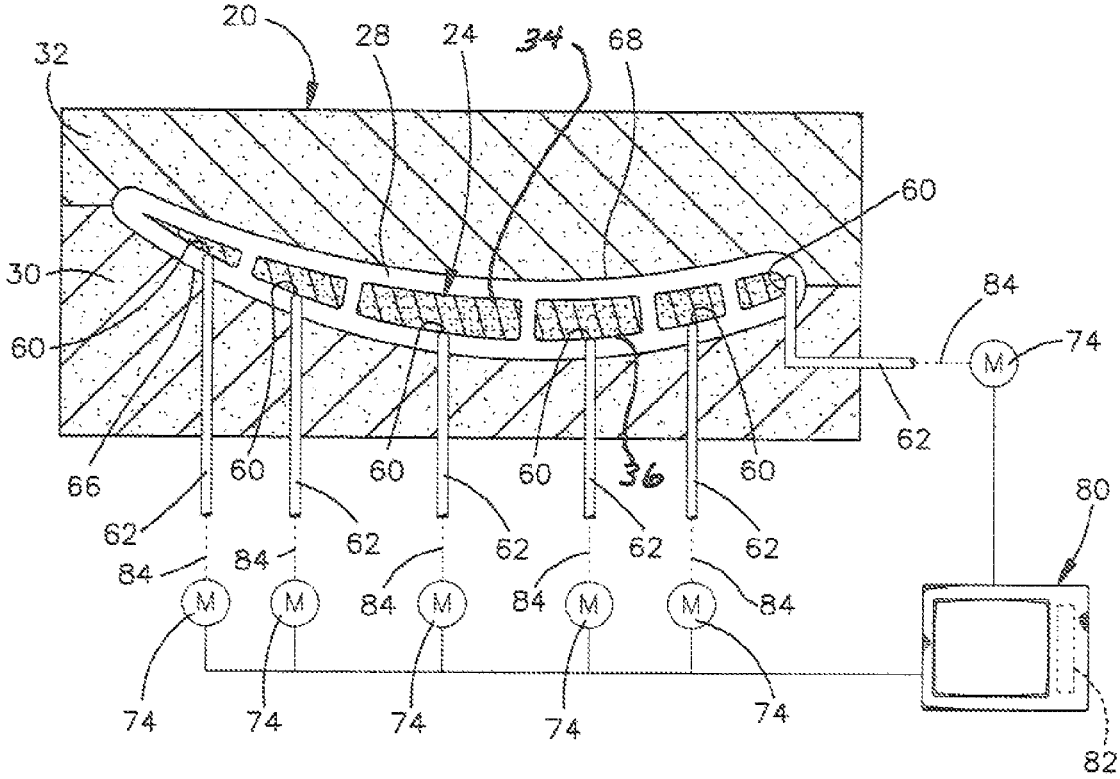
FIG. 4 is a schematic illustration depicting an apparatus utilized to position an actual core in the die with the actual core in a best fit spatial relationship with a spatial envelope for an ideal core.

The motors 74 are connected with the core positioning members 62 by suitable drive trains 84 (FIG. 4). The drive trains 84 may have any desired construction. The illustrated drive trains 84 have internally threaded members which are disposed in engagement with externally threaded members. The internally threaded members may be connected with the motors 74 through suitable reduction gearing. The externally threaded members are connected with the core positioning members 62. Rather than using internal and external thread convolutions to effect movement of the core positioning members 62, the drive trains 84 may have cam surfaces to move core positioning members relative to the lower section 30 of the die 20.

The motors 74 are reversible. Therefore, the controller (computer) 80 can operate the motors 74 in one direction to move the core positioning members 62 upwardly (as viewed in FIG. 4). Alternatively, the controller 80 can operate the motors 74 in the opposite direction to move the core positioning members 62 downwardly.

The core positioning members 62 are moved relative to the lower section 30 of the die 20 with the die in an open condition and with the core 24 spaced from the die. When the die 20 is in an open condition, the upper section 32 of the die is spaced from the lower section 30 of the die so that a die cavity surface 66 (FIG. 4) in the lower die section is exposed. In addition, the locating surfaces 60 on the core positioning members 62 are exposed.

Once the controller 80 has operated the motors 74 to move the core locating surfaces 60 to desired positions relative to the lower section 30 of the die 20, the actual core 24 is positioned on the core locating surfaces 60 in the manner illustrated schematically in FIG. 4. At this time, the upper section 32 of the die 20 is spaced from the lower section 30 of the die. If desired, the core 24 may be positioned on the core locating surfaces 60 during operation of the motors 74 to move the core locating surfaces.

The die 20 is then operated to the closed condition (FIG. 4) by moving the upper die section 32 into engagement with the lower die section 30. The core 24 is positioned in a closed die cavity 28 in a best fit spatial relationship with the die cavity surfaces 66 and 68 by the core positioning members 62. The results in the actual core 24 forming passages in a cast metal article with the passages in a best fit relationship relative to the cast metal article.

Hot wax is injected under pressure, into the die cavity 28 with the die 20 in the closed condition illustrated in FIG. 4. At this time, the core 24 is positioned relative to the lower and upper die sections 30 and 32 by the core positioning members 62. The actual core 24 is positioned in a best fit spatial relationship with the spatial envelope for an ideal (perfect) core if the ideal core was positioned in a desired spatial relationship relative to the die. The actual core 24 is also positioned in a best fit spatial relationship relative to the die cavity 28.

The heated wax 26 (FIG. 1), which is injected into the closed die 20, flows around the core 24 and fills the die cavity 82 (FIG. 4) to form the pattern 22. The wax 26 may be either a natural wax or a synthetic wax. The core 24 is supported in the die 20 in such a manner as to prevent movement of the core relative to the die as the wax 26 is injected into the die cavity 28.

When the wax 26 is injected into the closed die 20 and flows around the core 24, the wax is hot to decrease its viscosity and increase its flowability. Once the wax 26 has cooled, the die 20 is operated to its open condition. The pattern 22 is then removed from the die.

The spatial relationship of the actual core 24 to the wax 26 in the pattern 22 is optimized by having the core in a best fit spatial relationship with the spatial envelope 52 of the ideal core when the actual core 24 is disposed in the die 20. This results in surfaces on the actual core 24 being in a best fit spatial relationship relative to the surfaces 66 and 68 of the die cavity 82.

After the pattern 22 has been covered with a slurry of ceramic mold material and the ceramic mold material dried, the wax 26 is removed from the resulting mold. At this time, the actual core 24 is disposed in a best fit spatial relationship relative to internal surfaces of the mold. By optimizing the position of the actual core 24 relative to internal surfaces of the mold, a metal article which is cast in the mold will have passages, that is internal spaces, which are in positions which are as close as possible to design positions relative to the external surfaces of the cast metal article. If the cast metal article is a blade or vane for use in a turbine engine, the cast metal article may be formed of a nickel chrome super alloy.

In the embodiment of the invention illustrated in FIGS. 1-4, there are five core locating surfaces 60 disposed on five core positioning members 62. It is contemplated that a greater or lesser number of core locating surfaces 60 and core locating members 62 may be utilized to position the actual core 24 relative to the die 20. For example, three locating surfaces 60 may be used on three core positioning members 62 if desired. Alternatively, seven core locating surfaces 60 may be provided on seven core positioning members 62 if desired. The number of motors 74 provided would correspond to the number of core positioning members to be utilized to position a core 24 relative to the die 20. If desired, two or more core locating surfaces 60 may be provided on a single core positioning member 62.

It is contemplated that motors, similar to the motors 74, may be utilized to adjust the positions of core locating surfaces 60 relative to a die 20 without determining a best fit spatial relationship of an actual core 24 to a spatial envelope 52 for an ideal core and/or to the die cavity 28. If this is done, the motors 74 may be operated to locate the core locating surfaces 60 in positions which they would have if an ideal core was being positioned in the die cavity 28. Of course, this would not optimize the position of the actual core 24 relative to the die cavity surfaces 66 and 68.

The concept of determining a best fit spatial relationship of an actual core 24 to a spatial envelope 52 for an ideal core may be utilized without providing motors, corresponding to the motors 74, to move the core locating surfaces 60 relative to a die 20. If this is done, the drive trains 84 for the core positioning members 62 may be manually actuated to move the core positioning members to locations in which the core locating surfaces would position an actual core 24 in a best fit spatial relationship with the die cavity 82.

In the foregoing description, the actual core 24 has been positioned in the die cavity 28 by determining a best fit spatial relationship of the actual core to a spatial envelope 52 for an ideal core. At least some of the core locating surfaces 60 are moved to actual core locating positions which are offset from ideal core locating positions. The actual core 24 is positioned in engagement with the core locating surfaces 60. Wax is conducted into the closed die 20 while the actual core 24 is in engagement with the core locating surfaces 60 and while the core locating surfaces are in the actual core locating positions.

By determining a best fit spatial relationship of the actual core 24 to the spatial envelope 52 for the ideal core and adjusting the core locating surfaces 70, a best fit spatial relationship of the actual core relative to the die cavity 28 is obtained. However, this may be done by determining a best fit spatial relationship of the actual core 24 to the die cavity 28. The core locating surfaces 60 would be adjusted to support the actual core 24 in the best fit spatial relationship relative to the die cavity.

When this is to be done, the computer determines the best fit spatial relationship of the data points measured by the coordinate-measuring machine 40 to the spatial envelope of the die cavity 28. Thus, the computer stores the dimensions and configuration of the die cavity 28. The dimensions and configuration of the die cavity 28 will correspond to the (design) dimensions and configuration of the exterior of a metal article to be cast using the pattern 22.

The actual core dimensions measured by the coordinate-measuring machine 40 enable a spatial envelope 50 for the actual core 24 to be determined. The spatial envelope 52 of the actual core is compared to the spatial envelope of the die cavity 28 by the computer. A best fit of the spatial envelope 50 of the actual core 24 to the spatial envelope of the die cavity 28 is determined by this comparison. The positions of the core locating surfaces 60, when they support the actual core 24 in a best fit position relative to the die cavity 28, are determined. The motors 74 are operated to move the core locating surfaces 60 to the positions in which the core locating surfaces can support the actual core 24 in a best fit position relative to the die cavity 28.

Once the core locating surfaces 60 have been moved to positions in which the core locating surfaces can support the actual core 24 in a best fit spatial relationship with the die cavity 28, the core is positioned in the die cavity on the core locating surfaces. The die 20 is then closed and hot wax is injected into the die cavity. The hot wax solidifies around the core 24 to form the pattern 22.

Figure 5:
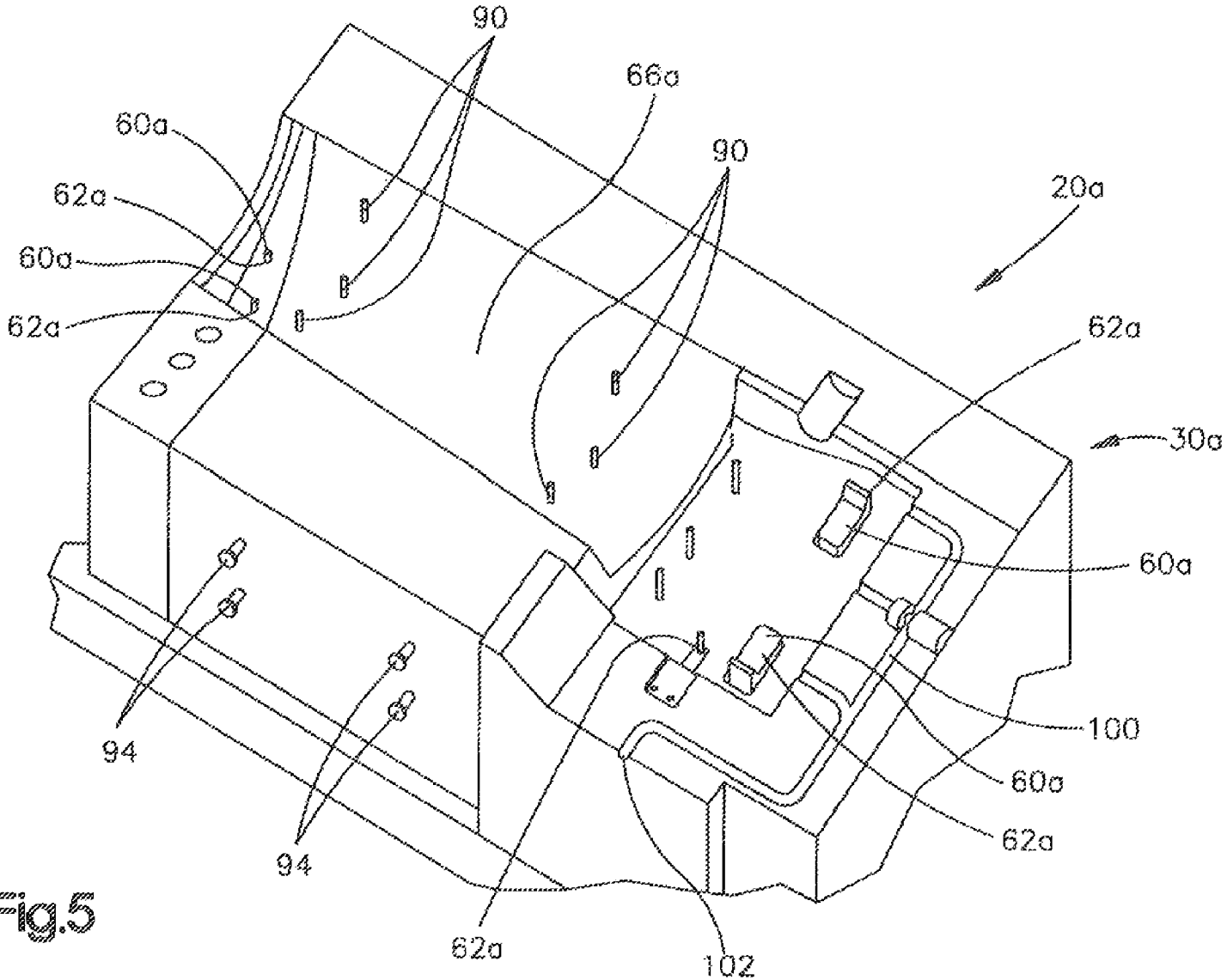
FIG. 5 is a schematic pictorial illustration of a lower section of a die, constructed in accordance with FIG. 4, which is utilized in the formation of a pattern.
Figure 6:
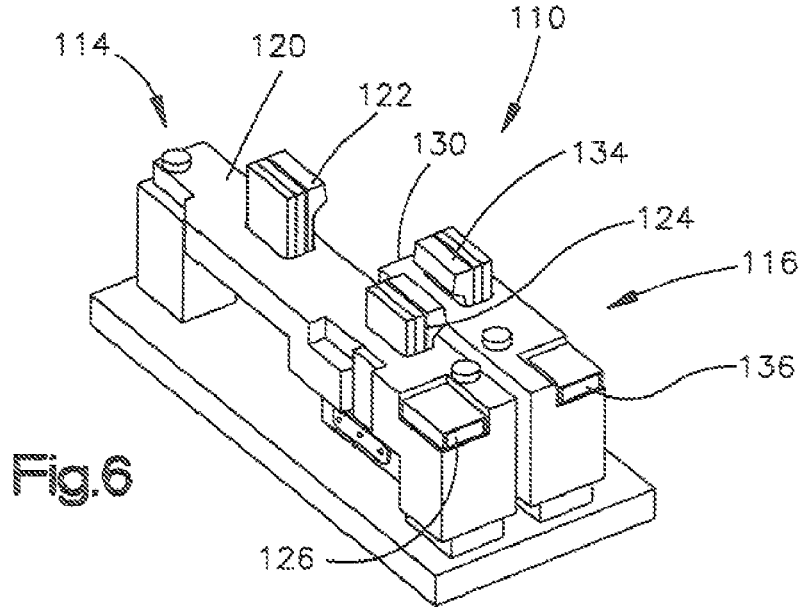
FIG. 6 is a schematic pictorial illustration of a plurality of gauge assemblies which may be utilized to determine the positions of locating surfaces in the die section of FIG. 5.
Figure 7:
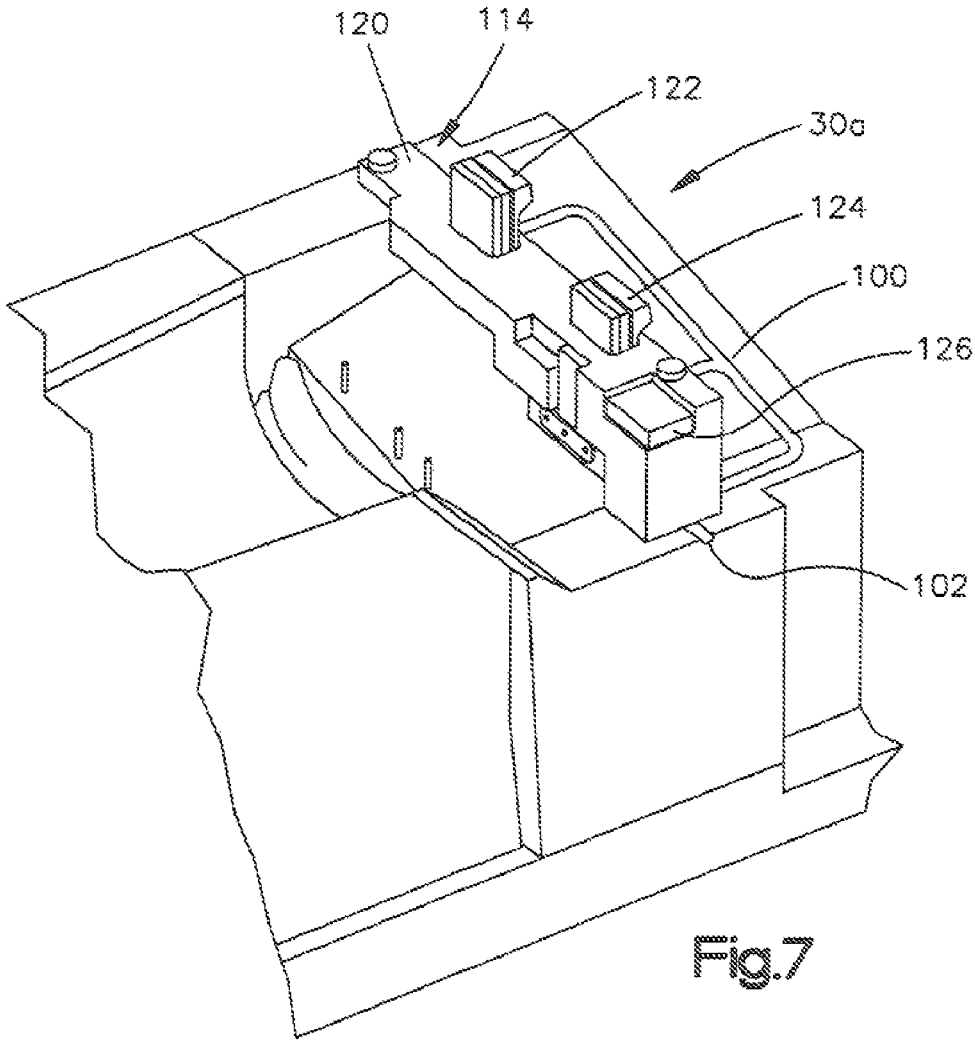
FIG. 7 is a schematic illustration depicting the manner in which one of the gauge assemblies of FIG. 6 is utilized in association with the die section of FIG. 5.

Embodiments of FIGS. 5-7

The lower section 30 of the die 20 has been illustrated schematically in FIGS. 1 and 4. One specific embodiment of the lower section 30 of the die 20 is illustrated in FIGS. 5-7. Since the embodiment of the invention illustrated in FIG. 5 is generally similar to the embodiments illustrated in FIGS. 1-4, numerals which are similar to the numerals utilized in association with the embodiment of the invention illustrated in FIGS. 1-4 will be utilized to identify components of the embodiment of the invention illustrated in FIGS. 5-7. The suffix letter "a" will be associated with the numerals of FIGS. 5-7 to avoid confusion.

A lower die section 30*a* includes a die cavity surface 66*a*. Core positioning members 62*a* have core locating surfaces 60*a* which engage an actual core in the manner illustrated schematically in FIG. 4. In addition, the core support members or pins 90 are provided in the lower die section 30*a*. The core support members 90 do not engage a core when it is initially positioned in the lower die section 30*a*. The core support members 90 engage a core 24 (FIGS. 1, 3, and 4), in the event of slight deflection of the core. The core support members 90 limit the range of deflection of the core 24.

The core positioning members 62*a* initially support the actual core in a die cavity in the manner illustrated schematically in FIG. 4. The core support members 90 engage and are effective to partially support the actual core only if there is deflection of one or more portions of the actual core during the injection of wax into the die 20*a*. Manually actuated controls 94 are provided to effect movement of the core support members 90 to desired positions relative to a core which is supported on the core locating surfaces 60*a* of the core positioning members 62*a*.

When an upper section of the die assembly 20*a* is moved to a closed position cooperating with the lower die section 30*a*, a passage 100 is formed to conduct wax into the closed die cavity. The passage 100 has an inlet 102 through which wax is injected into the passage.

Although motors, corresponding to the motors 74 of FIG. 4, are provided to move the core positioning members 62*a* on the lower die section 30*a* of FIG. 5, it is contemplated that it may, under certain circumstances, be desirable to manually adjust the positions of the core positioning members 62*a* and locating surfaces 60*a* relative to the lower die section. If this is to be done, a plurality 110 (FIG. 6) of gauge assemblies may be utilized. The plurality 110 of gauge assemblies includes a root end portion gauge assembly 114 and a tip end portion gauge assembly 116.

The root end portion gauge assembly 114 includes a base or support member 120 on which registers 122, 124 and 126 (FIG. 6) are mounted. The registers 122-126 are connected with actuators (not shown) which engage the core locating surfaces 60*a* (FIG. 5) on the core positioning members 62*a*. The tip end portion gauge assembly 116 (FIG. 6) includes a base or support member 130 on which registers 134 and 136 are disposed.

Actuators (not shown) are connected with the registers, 122, 124, and 126 of the root end portion gauge assembly 114 and engage core locating surfaces 60*a* on core positioning members 62*a* disposed adjacent to the root (right as viewed in FIG. 5) end portion of the lower die section 30*a*. Similarly, actuators (not shown) are utilized in association with the registers 134 and 136 in the tip end portion gauge assembly 116. The actuators associated with the tip end portion gauge assembly 116 engage core locating surfaces 60*a* on core positioning members 62*a* disposed adjacent to the tip or left (as viewed in FIG. 5) end portion of the lower die section 30*a*. The registers 122, 124, 126, 134 and 136 hold data which indicates the position of the core locating surface 60*a* engaged by the actuator associated with the register.

The registers 122, 124, 126, 134, and 136 are mechanical registers which are actuated by movement of actuators connected to the registers. However, the registers 122, 124, 126, 134 and 136 may be electrical registers or data storage units. If this is the case, a suitable power source, such as one or more batteries would be connected with the registers 122, 124, 126, 134 and 136.

When the root end portion gauge assembly 114 (FIG. 6) is to be utilized in positioning the core positioning members 62*a* adjacent to the root or right (as viewed in FIG. 5) end portion of the lower die section 30*a*, the root end portion gauge assembly is positioned on the lower die section 30*a* in the manner illustrated in FIG. 7. The base or support member 120 engages the lower die section 30*a* and spans a portion of the lower die section. The registers 122 and 124 are disposed above core positioning members 62*a* disposed in the lower right end portion of the lower die section 30*a*. The register 126 is disposed above and is offset to one side of a third core positioning member 62*a* in the root end portion of the lower die section.

Actuators associated with the registers 122-126 engage the core locating surfaces 60*a* associated with the core positioning members 62*a* across which the base or support member 120 extends. One or more drive trains, corresponding to the drive trains 84 of FIG. 4, may be manually actuated to move the core positioning members 62*a* to the desired positions relative to the lower die section 30*a*. The registers 122-126 have displays which indicate the positions of the associated core locating surfaces 60*a*.

The tip end portion gauge assembly 116 is utilized in association with the core positioning members 62*a* adjacent to the tip or left (as viewed in FIG. 5) end portion of the lower die section 30*a*. When this is to be done, the base or support member 130 (FIG. 6) of the tip end portion gauge assembly 116 is mounted on the tip or left (as viewed in FIG. 5) end portion of the lower die section 30*a*. The register 134 on the base or support member 130 (FIG. 6) of the tip end portion gauge assembly 116 will be disposed above a core locating surface 60*a* at the tip end portion of the lower die section 30*a*. The register 136 will be disposed above and offset to one side of a second core locating surface 60*a* associated with a second core positioning member 62*a* at the tip end portion of the lower die section 30*a*.

The actuators for the registers 134 and 136 engage the core locating surfaces 60*a* at the tip end portion of the lower die section 30*a* and indicate the positions of the gauged core locating surfaces 60*a* relative to the lower die section 30*a*. Drive trains, corresponding to the core drive trains 84 of FIG. 4, may be manually operated to effect movement of the associated core positioning members to the desired positions relative to the lower die section 30*a*. The registers 134 and 136 have displays which indicate the positions of the associated core locating surfaces 60*a*.

Figure 8:
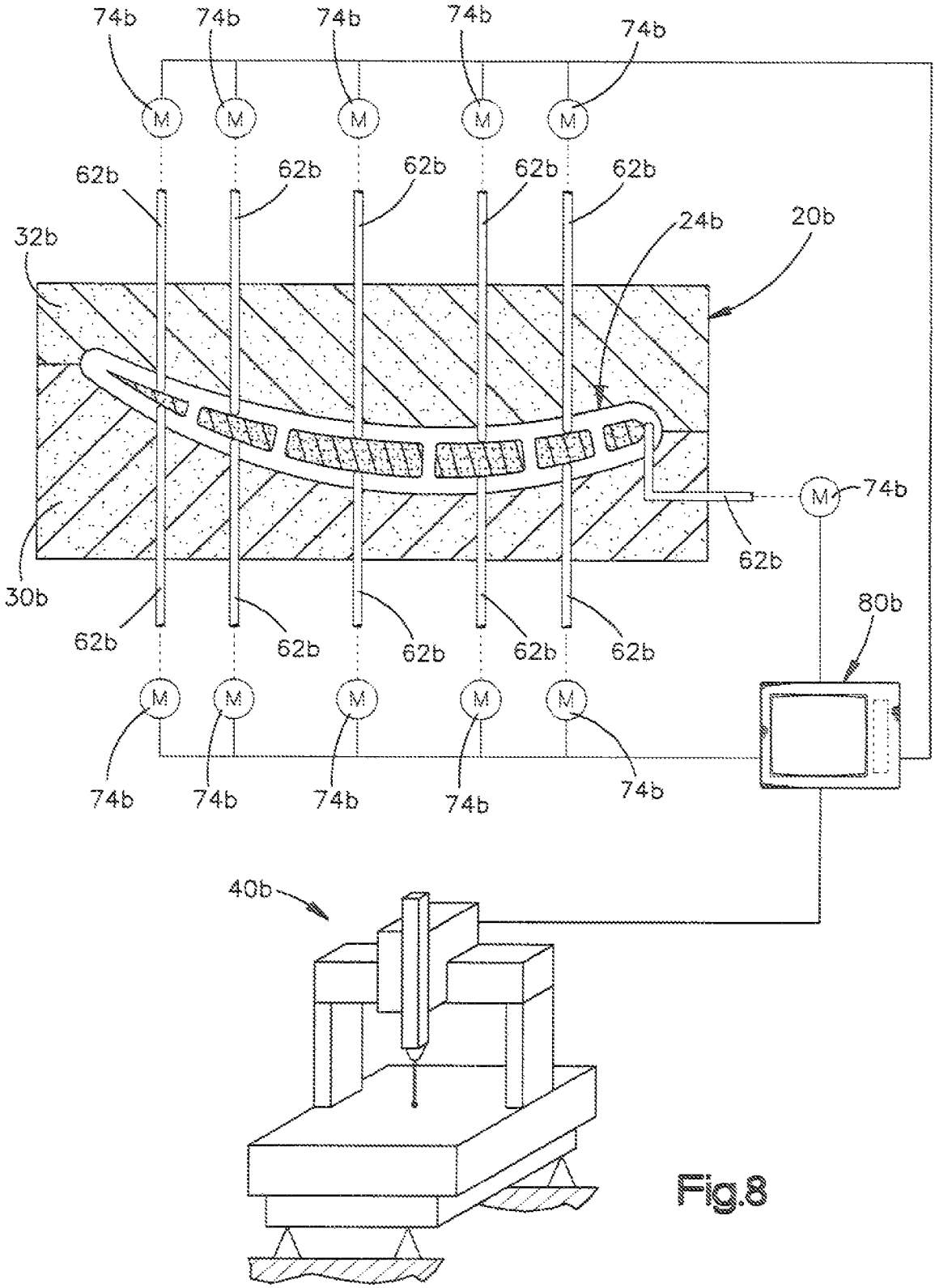
FIG. 8 is a schematic illustration, depicting the manner in which motors may be utilized to position locating surfaces in lower and upper sections of a die and the manner in which the coordinate-measuring machine of FIG. 2 may be connected with control apparatus for the motors.

Embodiment of FIG. 8

In the embodiments of the invention illustrated in FIGS. 1-7, core positioning members 62 are illustrated in association with the lower section 30 of the die 20. In the embodiment of the invention illustrated in FIG. 8, core positioning members are associated with both the lower die section and upper die section. Since the embodiment of the invention illustrated in FIG. 8 is generally similar to the embodiments of the invention illustrated in FIGS. 1-7, similar numerals will be utilized to designate similar components, the suffix letter "b" being associated with the numerals of FIG. 8 to avoid confusion.

A die 20*b* (FIG. 8) includes a lower section 30*b* and an upper section 32*b*. In accordance with one of the features of the embodiment of the invention illustrated in FIG. 8, core positioning members 62*b* are provided in association with both the lower die section 30*b* and upper die section 32*b*. The core positioning members 62*b* connected with the lower die section 30*b* engage lower side of the core 24*b*. Similarly, the core positioning members 62*b* associated with the upper die section 32*b* engage the upper side of the core 24*b*.

Motors 74*b* are operable by a controller 80*b* to effect movement of the core positioning members 62*b* to desired positions relative to lower and upper die sections 30*b* and 32*b*. The controller 80*b* includes a computer which is connected with and receives the output from the coordinate-measuring machine 40*b*. This enables the computer in the controller 80*b* to determine a best fit spatial relationship of the actual core 24*b* to a spatial envelope for an ideal core, that is, to a spatial envelope corresponding to the spatial envelope 52 of FIG. 3.

In the embodiment of the invention illustrated in FIG. 8, the core positioning members 62*b* associated with the upper die section 32*b* are axially aligned with the core positioning members 62*b* associated with the lower die section 30*b*. If desired, the core positioning members 62*b* associated with the upper die section 32*b* may be axially offset from the core positioning members 62*b* associated with a lower die section 30*b*. It should be understood that either a greater or lesser number of core positioning members 62*b* may be associated with the upper die section 32*b* if desired. Similarly, either a greater or lesser number of core positioning members 62*b* may be associated with the lower die section 30*b*. It should also be understood that gauge assemblies, corresponding to the gauge assemblies 114 and 116 of FIG. 6, may be utilized in association with the core positioning members 62*b* associated with the upper die section 32*b* as well as the lower die section 30*b*.

Although core positioning members 62*b* have been illustrated in FIG. 3 in association with both lower and upper die sections 30*b* and 32*b*, the positioning members may be associated with only one of the die sections if desired. For example, core positioning members 62*b* may be associated with only the upper die section 32*b*. Although motors 74*b* have been illustrated in FIG. 8 in association with core positioning members 62*b* for both lower and upper die sections 30*b* and 32*b*, the motors may be associated with core positioning members for only one of the die sections if desired. For example, motors 74*b* may be associated with core positioning members 62*b* for only the upper die section 32*b*.

Conclusion

In the view of the foregoing description it is apparent that the present invention provides a new and improved method of forming a pattern 22 which includes a core 24 which is at least partially covered by wax 26. The method includes providing an actual core 24 having dimensions which differ from dimensions of an ideal core, that is, a core which exactly conforms to a specific design for the core. A best fit spatial relationship of the actual core 24 to a spatial envelope 52 for the ideal core 24 may be determined. This results in space formed by the actual core 24 in a cast metal article having a best fit relationship with the cast metal article. If desired a best fit spatial relationship of the actual core 24 to a pattern die cavity 28 may be determined, rather than a best fit with an ideal core.

A die 20 having a plurality of core locating surfaces 60 is provided. The core locating surfaces 60 in the die 20 are movable between a plurality of positions, including ideal core locating positions in which the ideal core would be positioned in a desired spatial relationship relative to the die. The core locating surfaces 60 in the die 20 are movable to actual core locating positions which are offset from the ideal core locating positions. When the core locating surfaces 60 are in the actual core locating positions, an actual core 24 which is disposed in engagement with the core locating surfaces 60 is positioned in a best fit spatial relationship with the spatial envelope 52 for the ideal core. This results in the actual core 24 being positioned in a best fit relationship with a die cavity 28 in which the pattern 22 is formed.

The actual core 24 is positioned in engagement with the core locating surfaces 60 while the core locating surfaces are in the actual core locating positions. A flow of wax 26 is conducted into the die 20 while the actual core 24 is in engagement with the core locating surfaces 60 and while the core locating surfaces are in the actual core locating positions.

A plurality of motors 74 may be utilized to move the core locating surfaces 60 relative to the die 20. In one embodiment of the invention, the core locating surfaces 60 which are moved by the motors 74 are disposed in association with only one section, for example, the lower section 30, of the die 20. However, motors 74 may be associated with locating surfaces 60 associated with a second section, in the example, the upper section 32, of the die 20 if desired.

The present invention has a plurality of different features. These features may be utilized together as disclosed herein or may be utilized separately and/or in combination with features from the prior art. For example, core locating surfaces 60 may be moved by manually actuating one or more drive trains 84. As another example, motors 74 may be utilized to move core locating surfaces 60 to positions other than positions in which an actual core 24 is positioned in a best fit relationship with a spatial envelope for an ideal core.

Having described the invention, the following is claimed:

1. A method of forming a pattern which includes a core which is at least partially covered by wax, said method comprising the steps of providing an actual core, providing a die having a plurality of core locating surfaces which are movable between a plurality of positions, operating at least some motors of a plurality of motors connected with core locating surfaces to move core locating surfaces to locating positions for the actual core, changing data in at least some registers of a plurality of registers as a function of movement of at least some core locating surfaces of the plurality of core locating surfaces, positioning the actual core in engagement with core locating surfaces, and conducting a flow of wax into the die while the actual core is in engagement with core locating surfaces.

2. A method as set forth in claim 1 wherein the actual core has dimensions which differ from dimensions of an ideal core, said locating surfaces being movable between a plurality of positions which include ideal core locating positions in which the ideal core would be positioned in a desired spatial relationship relative to the die and actual core locating positions, at least some of the actual core locating positions being offset from ideal core locating positions.

3. A method as set forth in claim 2 further including the step of determining a best fit spatial relationship of the actual core to a spatial envelope for the ideal core.

4. A method of forming a pattern which includes a core which is at least partially covered by wax, said method comprising the steps of providing a core, providing a die operable between a closed condition in which first and second sections of the die at least partially define a die cavity and an open condition in which at least portions of the first and second sections of the die are spaced apart to provide access to the die cavity, providing first core locating surfaces which are associated with the first section of the die and second core locating surfaces which are associated with the second section of the die, operating a first group of motors connected with the first core locating surfaces to move the first core locating surfaces to first core locating positions, operating a second group of motors connected with the second core locating surfaces to move the second core locating surfaces to second core locating positions, changing data in at least some registers of a plurality of registers as a function of movement of at least some core locating surfaces of the plurality of core locating surfaces, positioning the core in engagement with the first core locating surfaces while the first core locating surfaces are in their first core locating positions and while the die is in the open condition, operating the die from the open condition to the closed condition, and conducting a flow of wax into the die while the die is in the closed condition and while the core is in engagement with the first core locating surfaces.

5. A method as set forth in claim 4 further including the step of restricting movement of the core relative to the die with at least some of the second core locating surfaces during performance of said step of conducting a flow of wax into the die.

6. A method as set forth in claim 5 further including the step of determining a best fit spatial relationship of the actual core to a spatial envelope for an ideal core.

7. A method of forming a pattern which includes a core which is at least partially covered by wax, said method comprising the steps of providing an actual core, determining a best fit spatial relationship of the actual core to a spatial envelope for an ideal core, providing a die having a plurality of core locating surfaces which are movable between a plurality of positions, operating at least some motors of a plurality of motors to move core locating surfaces to actual core locating positions in which the actual core is positioned in a best fit spatial relationship with a spatial envelope for the ideal core when the ideal core is in a desired spatial relationship to the die, changing data in at least some registers of a plurality of registers as a function of movement of at least some core locating surfaces of the plurality of core locating surfaces, positioning the actual core in engagement with the plurality of core locating surfaces while the core locating surfaces are in the actual core locating positions, and conducting a flow of wax into the die while the actual core is in engagement with core locating surfaces and while core locating surfaces are in the actual core locating positions.

8. A method of forming a pattern which includes a core which is at least partially covered by wax, said method comprising the steps of providing an actual core having dimensions which differ from dimensions of an ideal core, measuring the actual core to determine the configuration of the actual core, determining a best fit spatial relationship of the actual core to a spatial envelope for the ideal core, said step of determining a best fit spatial relationship of the actual core to a spatial envelope for the ideal core includes comparing the measured configuration of the actual core to the configuration of the ideal core and determining distances from points on the actual core to corresponding points on the ideal core when there is a best fit spatial relationship of the actual core to the spatial envelope of the ideal core, providing a die having a plurality of core locating surfaces which are movable between a plurality of positions including ideal core locating positions in which the ideal core would be positioned in a desired spatial relationship relative to the die and actual core locating positions in which the actual core is positioned in a best fit spatial relationship with the spatial envelope for the ideal core when the ideal core is in the desired spatial relationship to the die, at least some of the actual core locating positions being offset from the ideal core locating positions, positioning the actual core in engagement with the plurality of core locating surfaces while the core locating surfaces are in the actual core locating positions, and conducting a flow of wax into the die while the actual core is in engagement with core locating surfaces and while core locating surfaces are in the actual core locating positions.

9. A method as set forth in claim 8 further including moving at least some of the plurality of the core locating surfaces relative to the die to actual core locating positions which are offset from ideal core locating positions by distances which are a function of the distances from points on the actual core to corresponding points on the ideal core.

10. A method as set forth in claim 8 wherein said step of moving at least some of the plurality of core locating surfaces relative to the die includes operating at least some motors of a plurality of motors which are connected with the core locating surfaces.

11. A method as set forth in claim 10 wherein said step of positioning the actual core in engagement with the plurality of core locating surfaces includes engaging at least three core locating surfaces which are disposed to one side of the core after operating at least one of the motors.

12. A method as set forth in claim 8 wherein the pattern is to be utilized during the casting of an airfoil having convex and concave sides, the actual core has a convex side which extends between tip and root end portions of the actual core and which is utilized in forming a convex side of an opening in the airfoil, and the actual core has a concave side which extends between the tip and the root end portions of the actual core and which is utilized in forming a concave side of the opening in the airfoil, said step of positioning the actual core in engagement with the plurality of core locating surfaces includes engaging the tip end portion of the actual core with at least one of the core locating surfaces and engaging the root end position of the actual core with at least one of the core locating surfaces.

13. A method as set forth in claim 8 wherein the pattern is to be utilized during the casting of an airfoil having convex and concave sides, the actual core has a convex side which extends between tip and root end portions of the actual core and which is utilized in forming a convex side of an opening in the airfoil, and the actual core has a concave side which extends between the tip and root end portions of the actual core and which is utilized in forming a concave side of the opening in the airfoil, said step of positioning the actual core in engagement with the plurality of core locating surfaces includes engaging the tip end portion of the actual core with at least two of the core locating surfaces and engaging the root end portion of the actual core with at least two of the core locating surfaces.

14. A method as set forth in claim 8 further including the step of providing a plurality of registers which hold data corresponding to positions of at least some of the core locating surfaces of the plurality of core locating surfaces, moving at least one of the core locating surfaces relative to the die, changing data in at least one of the registers during movement of at least one of the core locating surfaces relative to the die and interrupting movement of at least one of the core locating surfaces relative to the die when data stored in at least one of the registers corresponds to at least one of the actual core locating positions.

15. A method as set forth in claim 8 further including the step of engaging a core locating surface with an actuator which effects operation of a register to a condition indicating an actual position of the core locating surface, and moving the core locating surface to a position in which the register indicates that the core locating surface is in one of the actual core locating positions.

16. A method of forming a pattern which includes a core which is at least partially covered by wax, said method comprising the steps of providing an actual core having dimensions which differ from dimensions of an ideal core, determining a best fit spatial relationship of the actual core to a spatial envelope for the ideal core, providing a die having a plurality of core locating surfaces which are movable between a plurality of positions including ideal core locating positions in which the ideal core would be positioned in a desired spatial relationship relative to the die and actual core locating positions in which the actual core is positioned in a best fit spatial relationship with the spatial envelope for the ideal core when the ideal core is in the desired spatial relationship to the die, at least some of the actual core locating positions being offset from the ideal core locating positions, providing a plurality of registers which hold data corresponding to positions of at least some of the core locating surfaces of the plurality of core locating surfaces, moving at least one of the core locating surfaces relative to the die, changing data in at least one of the registers during movement of at least one of the core locating surfaces relative to the die, interrupting movement of at least one of the core locating surfaces relative to the die when data stored in at least one of the registers corresponds to at least one of the actual core locating positions, positioning the actual core in engagement with the plurality of core locating surfaces while the core locating surfaces are in the actual core locating positions, and conducting a flow of wax into the die while the actual core is in engagement with core locating surfaces and while core locating surfaces are in the actual core locating positions.

17. A method as set forth in claim 16 further including the step of measuring the actual core to determine the configuration of the actual core, said step of determining a best fit spatial relationship of the actual core to a spatial envelope for the ideal core includes comparing the measured configuration of the actual core to the configuration of the ideal core and determining distances from points on the actual core to corresponding points on the ideal core when there is a best fit spatial relationship of the actual core to the spatial envelope of the ideal core.

18. A method as set forth in claim 16 wherein said step of moving at least one of the core locating surfaces relative to the die includes operating at least one motor which is connected with the one of the core locating surfaces.

19. A method as set forth in claim 16 wherein said step of positioning the actual core in engagement with the plurality of core locating surfaces includes engaging at least three core locating surfaces which are disposed to one side of the core and are disposed in actual core locating positions.

20. A method as set forth in claim 16 further including the step of actuating at least one drive train of a plurality of drive trains to perform said step of moving at least one of said core locating surfaces of said plurality of core locating surfaces relative to the die.

21. A method as set forth in claim 20 wherein said step of actuating at least one drive train includes operating at least one motor of a plurality of motors.

22. A method as set forth in claim 21 wherein said step of actuating at least one drive train includes manually actuating the at least one drive train.

23. A method as set forth in claim 17 further including the steps of spanning at least a portion of the die with a support member, effecting operation of a plurality of registers on the support member to conditions indicating actual positions of core locating surfaces associated with the registers, and moving core locating surfaces to positions in which registers disposed on the support member and associated with the core locating surfaces indicate that the core locating surfaces are in actual core locating positions.

24. A method of forming a pattern which includes a core which is at least partially covered by wax, said method comprising the steps of providing an actual core having dimensions which differ from dimensions of an ideal core, determining a best fit spatial relationship of the actual core to a spatial envelope for the ideal core, providing a die having a plurality of core locating surfaces which are movable between a plurality of positions including ideal core locating positions in which the ideal core would be positioned in a desired spatial relationship relative to the die and actual core locating positions in which the actual core is positioned in a best fit spatial relationship with the spatial envelope for the ideal core when the ideal core is in the desired spatial relationship to the die, at least some of the actual core locating positions being offset from the ideal core locating positions, engaging a core locating surface with an actuator which effects operation of a register to a condition indicating an actual position of the core locating surface, moving the core locating surface to a position in which the register indicates that the core locating surface is in one of the actual core locating positions, positioning the actual core in engagement with the plurality of core locating surfaces while the core locating surfaces are in the actual core locating positions, and conducting a flow of wax into the die while the actual core is in engagement with core locating surfaces and while core locating surfaces are in the actual core locating positions.

25. A method as set forth in claim 24 further including moving at least some of the plurality of the core locating surfaces relative to the die to actual core locating positions which are offset from ideal core locating positions by distances which are a function of distances from points on the actual core to corresponding points on the ideal core.

26. A method as set forth in claim 25 wherein said step of moving at least some of the plurality of core locating surfaces relative to the die includes operating at least some, motors of a plurality of motors which are connected with the core locating surfaces.

27. A method as set forth in claim 25 wherein said step of moving at least some of the plurality of core locating surfaces relative to the die includes actuating at least one drive train of a plurality of drive trains.

28. A method of forming a pattern which includes a core which is at least partially covered by wax, said method comprising the steps of providing an actual core having dimensions which differ from dimensions of an ideal core, determining a best fit spatial relationship of the actual core to a spatial envelope for the ideal core, providing a die having a plurality of core locating surfaces which are movable between a plurality of positions including ideal core locating positions in which the ideal core would be positioned in a desired spatial relationship relative to the die and actual core locating positions in which the actual core is positioned in a best fit spatial relationship with the spatial envelope for the ideal core when the ideal core is in the desired spatial relationship to the die, at least some of the actual core locating positions being offset from the ideal core locating positions, spanning at least a portion of the die with a support member, effecting operation of a plurality of registers on the support member to conditions indicating actual positions of core locating surfaces associated with the registers, associated with the core locating surfaces indicate that the core locating surfaces are in actual core locating positions, moving core locating surfaces to positions in which registers associated with the core locating surfaces indicate that the core locating surfaces are in actual core locating positions.

29. A method as set forth in claim 28 wherein said step of moving core locating surfaces includes operating a plurality of motors which are connected with the core locating surfaces.

30. A method as set forth in claim 28 wherein said step of moving core locating surfaces includes manually actuating a plurality of drive trains to move said core locating surfaces.

31. A method as set forth in claim 28 further including the step of measuring the actual core to determine the configuration of the actual core, said step of determining a best fit spatial relationship of the actual core to a spatial envelope for the ideal core includes comparing the measured configuration of the actual core to the configuration of the ideal core and determining distances from points on the actual core to corresponding points on the ideal core when there is a best fit spatial relationship of the actual core to the spatial envelope of the ideal core.

32. A method as set forth in claim 31 further including moving at least some of the plurality of the core locating surfaces relative to the die to actual core locating positions which are offset from ideal core locating positions by distances which are a function of the distances from points on the actual core to corresponding points on the ideal core.

33. A method as set forth in claim 31 wherein said step of moving at least some of the plurality of core locating surfaces relative to the die includes operating at least some motors of a plurality of motors which are connected with the core locating surfaces.

34. A method of forming a pattern which includes a core which is at least partially covered by wax, said method comprising the steps of providing an actual core, measuring the actual core to determine the configuration of the actual core, and determining the distances which points on the actual core are offset from corresponding points on an ideal core, providing a die having a plurality of core locating surfaces which are movable between a plurality of positions, operating at least some motors of a plurality of motors connected with core locating surfaces to move core locating surfaces to locating positions for the actual core, said step of operating at least some motors of a plurality of motors includes moving core locating surfaces to locations which are offset from ideal core locating positions by amounts corresponding to the distances which points on the actual core are offset from corresponding points on the ideal core, positioning the actual core in engagement with core locating surfaces, and conducting a flow of wax into the die while the actual core is in engagement with core locating surfaces.

35. A method as set forth in claim 34 wherein the actual core has dimensions which differ from dimensions of an ideal core, said locating surfaces being movable between a plurality of positions which include ideal core locating positions in which the ideal core would be positioned in a desired spatial relationship relative to the die and actual core locating positions, at least some of the actual core locating positions being offset from ideal core locating positions.

36. A method as set forth in claim 35 further including the step of determining a best fit spatial relationship of the actual core to a spatial envelope for the ideal core.

37. A method as set forth in claim 34 further including the step of providing a plurality of registers which hold data corresponding to positions of at least some of the core locating surfaces, and changing data in at least one of the registers during operation of at least one of the motors and movement of at least one of the core locating surfaces relative to the die.

38. A method of forming a pattern which includes a core which is at least partially covered by wax, said method comprising the steps of providing an actual core, measuring the actual core to determine the configuration of the actual core, determining a best fit spatial relationship of the actual core to a spatial envelope for an ideal core, said step of determining a best fit spatial relationship of the actual core to a spatial envelope for the ideal core includes comparing the measured configuration of the actual core to the configuration of the ideal core and determining distances from points on the actual core to corresponding points on the ideal core when there is a best fit spatial relationship of the actual core to the spatial envelope of the ideal core, providing a die having a plurality of core locating surfaces which are movable between a plurality of positions, operating at least some motors of a plurality of motors to move core locating surfaces to actual core locating positions in which the actual core is positioned in a best fit spatial relationship with a spatial envelope for the ideal core when the ideal core is in a desired spatial relationship to the die, positioning the actual core in engagement with the plurality of core locating surfaces while the core locating surfaces are in the actual core locating positions, and conducting a flow of wax into the die while the actual core is in engagement with core locating surfaces and while core locating surfaces are in the actual core locating positions.

39. A method as set forth in claim 38 further including moving at least some of the plurality of the core locating surfaces relative to the die to actual core locating positions which are offset from ideal core locating positions by distances which are a function of the distances from points on the actual core to corresponding points on the ideal core.

40. A method as set forth in claim 38 further including the step of providing a plurality of registers which hold data corresponding to positions of at least some of the core locating surfaces of the plurality of core locating surfaces, operating at least one of the motors to move at least one of the core locating surfaces relative to the die, changing data in at least one of the registers during movement of at least one of the core locating surfaces relative to the die and interrupting operation of the one motor when data stored in the one of the register corresponds to at least one of the actual core locating positions.

41. A method as set forth in claim 38 further including the step of engaging a core locating surface with an actuator which effects operation of a register to a condition indicating an actual position of the core locating surface, and operating at least one of the motors to move the core locating surface to a position in which the register indicates that the core locating surface is in one of the actual core locating positions.

42. A method as set forth in claim 38 further including the steps of spanning at least a portion of the die with a support member, effecting operation of at least one motor in the plurality of motors to operate at least one register in a plurality of registers on the support member to a condition indicating an actual position of core a locating surface associated with the one register, and moving a core locating surface to a position in which the at least one register indicates that the core locating surface is in an actual core locating position.

43. A method of forming a pattern which includes a core which is at least partially covered by wax, said method comprising the steps of providing an actual core, determining a best fit spatial relationship of the actual core to a spatial envelope for an ideal core, providing a die having a plurality of core locating surfaces which are movable between a plurality of positions, providing a plurality of registers which hold data corresponding to positions of at least some of the core locating surfaces of the plurality of core locating surfaces, operating at least some motors of a plurality of motors to move core locating surfaces to actual core locating positions in which the actual core is positioned in a best fit spatial relationship with a spatial envelope for the ideal core when the ideal core is in a desired spatial relationship to the die, changing data in at least one of the registers during movement of at least one of the core locating surfaces relative to the die, interrupting operation of at least one motor when data stored in at least one register corresponds to at least one of the actual core locating positions, positioning the actual core in engagement with the plurality of core locating surfaces while the core locating surfaces are in the actual core locating positions, and conducting a flow of wax into the die while the actual core is in engagement with core locating surfaces and while core locating surfaces are in the actual core locating positions.

44. A method as set forth in claim 43 further including the step of measuring the actual core to determine the configuration of the actual core, said step of determining a best fit spatial relationship of the actual core to a spatial envelope for the ideal core includes comparing the measured configuration of the actual core to the configuration of the ideal core and determining distances from points on the actual core to corresponding points on the ideal core when there is a best fit spatial relationship of the actual core to the spatial envelope of the ideal core.

45. A method of forming a pattern which includes a core which is at least partially covered by wax, said method comprising the steps of providing an actual core, determining a best fit spatial relationship of the actual core to a spatial envelope for an ideal core, providing a die having a plurality of core locating surfaces which are movable between a plurality of positions, engaging a core locating surface with an actuator which effects operation of a register to a condition indicating an actual position of the core locating surface, operating at least some motors of a plurality of motors to move core locating surfaces to actual core locating positions in which the actual core is positioned in a best fit spatial relationship with a spatial envelope for the ideal core when the ideal core is in a desired spatial relationship to the die, said step of operating at least some motors of a plurality of motors includes operating at least one of the motors to move the core locating surface to a position in which the register indicates that the core locating surface is in one of the actual core locating positions, positioning the actual core in engagement with the plurality of core locating surfaces while the core locating surfaces are in the actual core locating positions, and conducting a flow of wax into the die while the actual core is in engagement with core locating surfaces and while core locating surfaces are in the actual core locating positions.

46. A method as set forth in claim 45 further including the step of measuring the actual core to determine the configuration of the actual core, said step of determining a best fit spatial relationship of the actual core to a spatial envelope for the ideal core includes comparing the measured configuration of the actual core to the configuration of the ideal core and determining distances from points on the actual core to corresponding points on the ideal core when there is a best fit spatial relationship of the actual core to the spatial envelope of the ideal core.

47. A method of forming a pattern which includes a core which is at least partially covered by wax, said method comprising the steps of providing an actual core, determining a best fit spatial relationship of the actual core to a spatial envelope for an ideal core, providing a die having a plurality of core locating surfaces which are movable between a plurality of positions, operating at least some motors of a plurality of motors to move core locating surfaces to actual core locating positions in which the actual core is positioned in a best fit spatial relationship with a spatial envelope for the ideal core when the ideal core is in a desired spatial relationship to the die, spanning at least a portion of the die with a support member, effecting operation of at least one motor in the plurality of motors to operate at least one register in a plurality of registers on the support member to a condition indicating an actual position of core a locating surface associated with the one register, and moving a core locating surface to a position in which the at least one register indicates that the core locating surface is in an actual core locating position.

48. A method of forming a pattern which includes a core which is at least partially covered by wax, said method comprising the steps of providing an actual core having dimensions which differ from dimensions of an ideal core, measuring the actual core to determine the configuration of the actual core, determining a best fit spatial relationship of the actual core to a die cavity, said step of determining a best fit spatial relationship of the actual core to the die cavity includes comparing the measured configuration of the actual core to the configuration of the die cavity and determining distances from points on the actual core to points on the die cavity, providing a plurality of core locating surfaces which are movable between a plurality of positions including actual core locating positions in which the actual core is positioned in a best fit spatial relationship with the die cavity, positioning the actual core in engagement with the plurality of core locating surfaces while the core locating surfaces are in the actual core locating positions, and conducting a flow of wax into the die while the actual core is in engagement with core locating surfaces and while core locating surfaces are in the actual core locating positions.

49. A method as set forth in claim 48 further including moving at least some of the plurality of the core locating surfaces relative to the die to actual core locating positions.

50. A method as set forth in claim 49 wherein said step of moving at least some of the plurality of core locating surfaces relative to the die includes operating at least some motors of a plurality of motors which are connected with the core locating surfaces.

51. A method as set forth in claim 48 wherein the pattern is to be utilized during the casting of an airfoil having convex and concave sides, the actual core has a convex side which extends between tip and root end portions of the actual core and which is utilized in forming a convex side of an opening in the airfoil, and the actual core has a concave side which extends between the tip and the root end portions of the actual core and which is utilized in forming a concave side of the opening in the airfoil, said step of positioning the actual core in engagement with the plurality of core locating surfaces includes engaging the tip end portion of the actual core with at least one of the core locating surfaces and engaging the root end position of the actual core with at least one of the core locating surfaces.

52. A method as set forth in claim 48 wherein the pattern is to be utilized during the casting of an airfoil having convex and concave sides, the actual core has a convex side which extends between tip and root end portions of the actual core and which is utilized in forming a convex side of an opening in the airfoil, and the actual core has a concave side which extends between the tip and root end portions of the actual core and which is utilized in forming a concave side of the opening in the airfoil, said step of positioning the actual core in engagement with the plurality of core locating surfaces includes engaging the tip end portion of the actual core with at least two of the core locating surfaces and engaging the root end portion of the actual core with at least two of the core locating surfaces.

53. A method as set forth in claim 48 further including the step of providing a plurality of registers which hold data corresponding to positions of at least some of the core locating surfaces of the plurality of core locating surfaces, moving at least one of the core locating surfaces relative to the die, changing data in at least one of the registers during movement of at least one of the core locating surfaces relative to the die and interrupting movement of at least one of the core locating surfaces relative to the die when data stored in at least one of the registers corresponds to at least one of the actual core locating positions.

54. A method as set forth in claim 48 wherein said step of moving at least one of said core locating surfaces of said plurality of core locating surfaces includes operating at least one motor of a plurality of motors.

55. A method as set forth in claim 48 further including the step of manually actuating at least one drive train of a plurality of drive trains to perform said step of moving at least one of said core locating surfaces of said plurality of core locating surfaces relative to the die.

56. A method as set forth in claim 48 further including the step of engaging a core locating surface with an actuator which effects operation of a register to a condition indicating an actual position of the core locating surface, and moving the core locating surface to a position in which the register indicates that the core locating surface is in one of the actual core locating positions.

57. A method as set forth in claim 48 further including the steps of spanning at least a portion of the die with a support member, effecting operation of a plurality of registers on the support member to conditions indicating actual positions of core locating surfaces associated with the registers, and moving core locating surfaces to positions in which registers associated with the core locating surfaces indicate that the core locating surfaces are in actual core locating positions.

58. A method as set forth in claim 57 wherein said step of moving core locating surfaces includes operating a plurality of motors which are connected with the core locating surfaces.

59. A method as set forth in claim 56 wherein said step of moving core locating surfaces includes manually actuating a plurality of drive trains to move said core locating surfaces.

60. A method of forming a pattern which includes a core which is at least partially covered by wax, said method comprising the steps of providing an actual core having dimensions which differ from dimensions of an ideal core, determining a best fit spatial relationship of the actual core to a die cavity, providing a plurality of core locating surfaces which are movable between a plurality of positions including actual core locating positions in which the actual core is positioned in a best fit spatial relationship with the die cavity, providing a plurality of registers which hold data corresponding to positions of at least some of the core locating surfaces of the plurality of core locating surfaces, moving at least one of the core locating surfaces relative to the die, changing data in at least one of the registers during movement of at least one of the core locating surfaces relative to the die, and interrupting movement of at least one of the core locating surfaces relative to the die when data stored in at least one of the registers corresponds to at least one of the actual core locating positions, positioning the actual core in engagement with the plurality of bore locating surfaces while the core locating surfaces are in the actual core locating positions, and conducting a flow of wax into the die while the actual core is in engagement with core locating surfaces and while core locating surfaces are in the actual core locating positions.

61. A method as set forth in claim 60 wherein said step of moving at least one of said core locating surfaces of said plurality of core locating surfaces includes operating at least one motor of a plurality of motors.

62. A method as set forth in claim 60 further including the step of manually actuating at least one drive train of a plurality of drive trains to perform said step of moving at least one of said core locating surfaces of said plurality of core locating surfaces relative to the die.

63. A method as set forth in claim 60 further including the step of engaging a core locating surface with an actuator which effects operation of a register to a condition indicating an actual position of the core locating surface, and moving the core locating surface to a position in which the register indicates that the core locating surface is in one of the actual core locating positions.

64. A method as set forth in claim 60 further including the steps of spanning at least a portion of the die with a support member, effecting operation of a plurality of registers on the support member to conditions indicating actual positions of core locating surfaces associated with the registers on the support member, and moving core locating surfaces to positions in which registers on the support member associated with the core locating surfaces indicate that the core locating surfaces are in actual core locating positions.

65. A method as set forth in claim 60 wherein said step of moving core locating surfaces includes operating a plurality of motors which are connected with the core locating surfaces.

66. A method as set forth in claim 60 wherein said step of moving core locating surfaces includes manually actuating a plurality of drive trains to move said core locating surfaces.

67. A method as set forth in claim 60 further including the step of measuring the actual core to determine the configuration of the actual core, said step of determining a best fit spatial relationship of the actual core to the die cavity includes comparing the measured configuration of the actual core to the configuration of the die cavity and determining distances from points on the actual core to points on the die cavity.

68. A method of forming a pattern which includes a core which is at least partially covered by wax, said method comprising the steps of providing an actual core having dimensions which differ from dimensions of an ideal core, determining a best fit spatial relationship of the actual core to a die cavity, providing a plurality of core locating surfaces which are movable between a plurality of positions including actual core locating positions in which the actual core is positioned in a best fit spatial relationship with the die cavity, engaging a core locating surface with an actuator which effects operation of a register to a condition indicating an actual position of the core locating surface, and moving the core locating surface to a position in which the register indicates that the core locating surface is in one of the actual core locating positions, positioning the actual core in engagement with the plurality of core locating surfaces while the core locating surfaces are in the actual core locating positions, and conducting a flow of wax into the die while the actual core is in engagement with core locating surfaces and while core locating surfaces are in the actual core locating positions.

69. A method of forming a pattern which includes a core which is at least partially covered by wax, said method comprising the steps of providing an actual core having dimensions which differ from dimensions of an ideal core, determining a best fit spatial relationship of the actual core to a die cavity, providing a plurality of core locating surfaces which are movable between a plurality of positions including actual core locating positions in which the actual core is positioned in a best fit spatial relationship with the die cavity, spanning at least a portion of the die with a support member, effecting operation of a plurality of registers on the support member to conditions indicating actual positions of core locating surfaces associated with the registers, and moving core locating surfaces to positions in which registers associated with the core locating surfaces indicate that the core locating surfaces are in actual core locating positions, positioning the actual core in engagement with the plurality of core locating surfaces while the core locating surfaces are in the actual core locating positions, and conducting a flow of wax into the die while the actual core is in engagement with core locating surfaces and while core locating surfaces are in the actual core locating positions.

70. A method of forming a pattern which includes a core which is at least partially covered by wax, said method comprising the steps of providing an actual core having dimensions which differ from dimensions of an ideal core, obtaining data which is a function of the configuration of the actual core, utilizing the data to determine a best fit spatial relationship of the actual core to a spatial envelope for the ideal core, said step of determining a best fit spatial relationship of the actual core to a spatial envelope for the ideal core includes determining spacing between points on the actual core and corresponding points on the ideal core when there is a best fit spatial relationship of the actual core to the spatial envelope of the ideal core, providing a die having a plurality of core locating surfaces which are movable between a plurality of positions including ideal core locating positions in which the ideal core would be positioned in a desired spatial relationship relative to the die and actual core locating positions in which the actual core, is positioned in a best fit spatial relationship with the spatial envelope for the ideal core when the ideal core is in the desired spatial relationship to the die, at least some of the actual core locating positions being offset from the ideal core locating positions, positioning the actual core in engagement with the plurality of core locating surfaces while the core locating surfaces are in the actual core locating positions, and conducting a flow of wax into the die while the actual core is in engagement with core locating surfaces and while core locating surfaces are in the actual core locating positions.

71. A method as set forth in claim 70 wherein said step of obtaining data which is a function of the configuration of the actual core includes the step of measuring the actual core.

72. A method as set forth in claim 70 further including moving at least some of the plurality of the core locating surfaces relative to the die to actual core locating positions which are offset from ideal core locating positions by distances which are a function of the spacing between points on the actual core and corresponding points on the ideal core.

73. A method as set forth in claim 72 wherein said step of moving at least some of the plurality of core locating surfaces relative to the die includes actuating at least some drive trains of a plurality of drive trains which are connected with the core locating surfaces.

74. A method as set forth in claim 73 wherein said step of operating at least some drive trains of a plurality of drive trains includes operating at least some motors of a plurality of motors which are connected with the drive trains.

75. A method as set forth in claim 70 wherein the pattern is to be utilized during the casting of an airfoil having convex and concave sides, the actual core has a convex side which extends between tip and root end portions of the actual core and which is utilized in forming a convex side of an opening in the airfoil, and the actual core has a concave side which extends between the tip and the root end portions of the actual core and which is utilized in forming a concave side of the opening in the airfoil, said step of positioning the actual core in engagement with the plurality of core locating surfaces includes engaging the convex side of the core with a plurality of core locating surfaces which are in actual core locating positions.

76. A method as set forth in claim 70 wherein the pattern is to be utilized during the casting of an airfoil having convex and concave sides, the actual core has a convex side which extends between tip and root end portions of the actual core and which is utilized in forming a convex side of an opening in the airfoil, and the actual core has a concave side which extends between the tip and root end portions of the actual core and which is utilized in forming a concave side of the opening in the airfoil, said step of positioning the actual core in engagement with the plurality of core locating surfaces includes engaging the tip end portion of the actual core with at least two of the core locating surfaces and engaging the root end portion of the actual core with at least two of the core locating surfaces, said steps of engaging the tip and root end portions of the actual core with locating surfaces includes engaging the tip and root end portions of the actual core with locating surfaces which are in their actual core locating positions.

77. A method as set forth in claim 70 further including the step of providing a plurality of registers which hold data corresponding to positions of at least some of the core locating surfaces of the plurality of core locating surfaces, moving at least one of the core locating surfaces relative to the die, changing data in at least one of the registers during movement of at least one of the core locating surfaces relative to the die and interrupting movement of at least one of the core locating surfaces relative to the die when data stored in at least one of the registers corresponds to at least one of the actual core locating positions.

78. A method as set forth in claim 77 wherein said step of moving at least one of said core locating surfaces of said plurality of core locating surfaces includes operating at least one motor of a plurality of motors.

79. A method as set forth in claim 77 further including the step of manually actuating at least one drive train of a plurality of drive trains to perform said step of moving at least one of said core locating surfaces of said plurality of core locating surfaces relative to the die.

80. A method as set forth in claim 70 further including the step of engaging a core locating surface with an actuator which effects operation of a register to a condition indicating an actual position of the core locating surface, and moving the core locating surface to a position in which the register indicates that the core locating surface is in one of the actual core locating positions.

81. A method as set forth in claim 70 further including the step of providing a plurality motors each which is connected with at least one of the core locating surfaces of the plurality of core locating surfaces, providing a plurality of registers which hold data corresponding to positions of at least some of the core locating surfaces, and changing data in at least one of the registers during operation of at least one of the motors and movement of at least one of the locating surfaces relative to the die.

82. A method of forming a pattern which includes a core which is at least partially covered by wax, said method comprising the steps of providing an actual core having dimensions which differ from dimensions of an ideal core, obtaining data which is a function of the configuration of the actual core, utilizing the data to determine a best fit spatial relationship of the actual core to a spatial envelope for the ideal core, providing a die having a plurality of core locating surfaces which are movable between a plurality of positions including ideal core locating positions in which the ideal core would be positioned in a desired spatial relationship relative to the die and actual core locating positions in which the actual core is positioned in a best fit spatial relationship with the spatial envelope for the ideal core when the ideal core is in the desired spatial relationship to the die, at least some of the actual core locating positions being offset from the ideal core locating positions, providing a plurality of drive trains each of which is connected with at least one core locating surface of the plurality of core locating surfaces, moving at least one of the core locating surfaces relative to the die to an actual core locating position by actuating at least one of the drive trains, positioning the actual core in engagement with the plurality of core locating surfaces while the core locating surfaces are in the actual core locating positions, and conducting a flow of wax into the die while the actual core is in engagement with core locating surfaces and while core locating surfaces are in the actual core locating positions.

83. A method as set forth in claim 82 wherein said step of obtaining data which is a function of the configuration of the actual core includes the step of measuring the actual core to determine the configuration of the actual core, said step of determining a best fit spatial relationship of the actual core to a spatial envelope for the ideal core includes comparing the measured configuration of the actual core to the configuration of the ideal core and determining distances from points on the actual core to corresponding points on the ideal core when there is a best fit spatial relationship of the actual core to the spatial envelope of the ideal core.

84. A method as set forth in claim 82 wherein said step of actuating at least one of the drive trains includes operating at least one motor of a plurality of motors which are connected with the core locating surfaces.

85. A method as set forth in claim 82 wherein said step of actuating at least one of the drive trains includes manually actuating at least one of the drive trains.

86. A method as set forth in claim 82 further including the step of providing a plurality of registers which hold data corresponding to positions of at least some of the core locating surfaces of the plurality of core locating surfaces, changing data in at least one of the registers during actuation of the one drive train and movement of at least one of the core locating surfaces relative to the die, and interrupting movement of the at least one of the core locating surfaces relative to the die when data stored in the one register corresponds to one of the actual core locating positions.

87. A method of forming a pattern which includes a core which is at least partially covered by wax, said method comprising the steps of providing an actual core having dimensions which differ from dimensions of an ideal core, measuring the actual core to determine the configuration of the actual core, comparing the measured configuration of the actual core to the configuration of the ideal core, providing a die having a plurality of core locating surfaces which are movable between a plurality of positions, providing a plurality of drive trains which are connected with the core locating surfaces, actuating at least one drive train of the plurality of drive trains to move at least one of the core locating surfaces to a position which is a function of differences between the measured configuration of the actual core and the configuration of the ideal core, positioning the actual core in engagement with the plurality of core locating surfaces after having performed said step of actuating at least one of the drive trains, and conducting a flow of wax into the die while the actual core is in engagement with core locating surfaces.

88. A method as set forth in claim 87 further including the step of providing a plurality of registers which hold data corresponding to positions of at least some of the core locating surfaces, and changing data in at least one of the registers during actuation of at least one of the drive trains and movement of at least one of the core locating surfaces relative to the die.

89. A method as set forth in claim 87 wherein said step of actuating at least one of the drive trains includes operating at least one motor of a plurality of motors which are connected with the drive trains.

90. A method as set forth in claim 87 wherein said step of positioning the actual core in engagement with the plurality of core locating surfaces includes engaging at least three core locating surfaces which are disposed to one side of the core.

91. A method as set forth in claim 87 wherein said step of actuating at least one of the drive trains includes manually actuating at least one of the drive trains.

92. A method as set forth in claim 87 further including the step of providing a plurality of registers which hold data corresponding to positions of at least some of the core locating surfaces of the plurality of core locating surfaces, changing data in at least one of the registers during actuation of at least one of the drive trains and movement of at least one of the core locating surfaces relative to the die, and interrupting actuation of the one drive train and movement of the one core locating surface relative to the die when data stored in one of the registers corresponds to a desired position of the one locating surface.

93. A method as set forth in claim 87 further including the step of engaging a core locating surface with an actuator which effects operation of a register to a condition indicating an actual position of the core locating surface, and moving the core locating surface to a position in which the register indicates that the core locating surface is in one of the actual core locating positions.

94. A method as set forth in claim 87 further including the step of determining a best fit spatial relationship of the actual core to a spatial envelope for the ideal core, said step of comparing the configuration of the actual core to the configuration of the ideal core includes determining distances from points on the actual core to corresponding points on the ideal core when there is a best fit spatial relationship of the actual core to the spatial envelope of the ideal core.

* * * * *